United States Patent [19]

McCaslin

[11] 4,091,648

[45] May 30, 1978

[54] PIPE GROOVING SYSTEMS

[75] Inventor: Joe C. McCaslin, Houston, Tex.

[73] Assignee: Zap-Lok Systems International, Houston, Tex.

[21] Appl. No.: 785,231

[22] Filed: Apr. 6, 1977

[51] Int. Cl.[2] ..... B21D 19/04

[52] U.S. Cl. ..... 72/121; 72/123; 72/124

[58] Field of Search ..... 72/118, 121, 122, 123, 72/124, 125, 126

[56] References Cited

U.S. PATENT DOCUMENTS

| | | | |
|---|---|---|---|
| 1,298,656 | 4/1919 | Brinkman | 72/120 |
| 2,445,303 | 7/1948 | Fisher | 72/124 |
| 3,010,506 | 11/1961 | Bellatorre | 72/124 |

*Primary Examiner*—Lowell A. Larson

[57] ABSTRACT

Apparatus for grooving the pin end of a pipe for use in a mechanical pipe joint of the pin and bell variety, and methods of forming a groove in a pin end, wherein the apparatus includes rollers for contacting the internal and external surfaces of a pipe and the rollers are rotatable as a pair of rollers about the axis of the pipe and are cooperable to groove and form the end of a pipe to the configuration of the rollers.

2 Claims, 5 Drawing Figures

FIG. 3
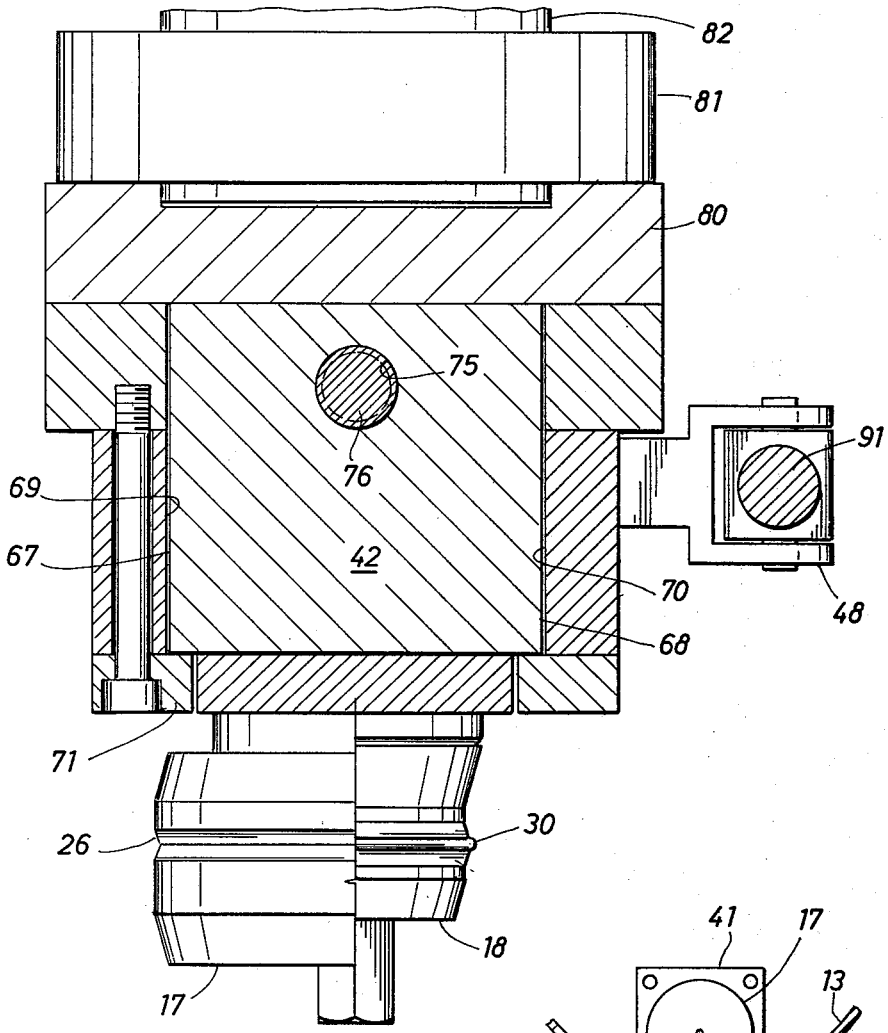
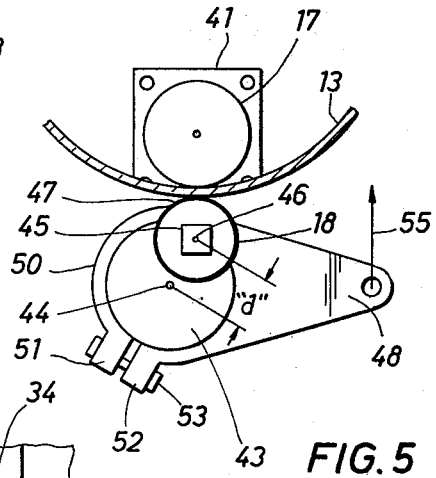
FIG. 5
FIG. 4
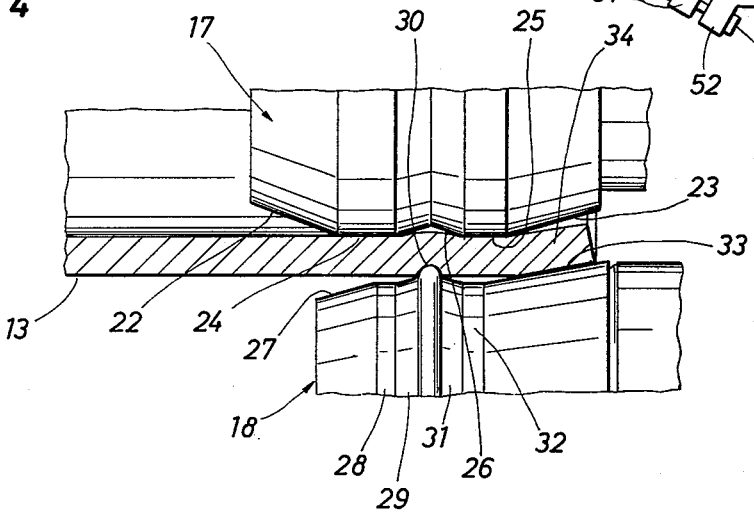

PIPE GROOVING SYSTEMS

BACKGROUND OF THE INVENTION

1. Field of the Invention

The present invention relates generally to systems for forming an end of a length of pipe to a desired configuration, and more particularly, to producing an annular groove in the end of a pipe and to form a turned-in end so that the pipe can function as the pin end for a pin and bell pipe connection.

2. Description of the Prior Art

Heretofor, one technique for joining pipes, tubing or the like consists of inserting one end of a pipe into the open end of another pipe. The insertable end is typically designated a "pin" end and the receiving end is designated a "bell" end. With this type joint there is a friction fit and an epoxy sealant is used to seal the space between the interfitted pipe portions. To enhance the seal, an annular groove or recess typically has been disposed near the terminal end of the pin end to retain a finite quantity of sealant. Also, the pin end has been turned inwardly at its terminal portion to facilitate entry into a bell end. Apparatus for grooving pipe has heretofor been disclosed in U.S. Pat. No. 3,473,359. In this patent, an external groove is formed by forcing a grooved roller into the exterior wall of a pipe. The structure includes equiangularly spaced rollers which act only on the exterior surface of the pipe. While this apparatus is satisfactory, the present invention has a wider range of application and produces a more uniform pipe end in a shorter period of time.

SUMMARY OF THE INVENTION

The present invention is directed to apparatus and methods for the formation of an annular groove and a turned-in end on the pin end of pipe for a pin and bell coupling. Although applicable to tubular elements, it is particularly applicable to tubular goods such as field-grade pipe, down-hole casing, and the like. It is also particularly well suited for aluminum and steel pipe.

The invention involves preforming the end of a pipe by use of internal and external rollers. The internal roller has an annular recess which is aligned in a common plane with an annular bead or projection on the external roller. The apparatus is constructed to allow positioning of the rollers against the wall surfaces and rotation of the rollers about the longitudinal axis of the pipe. During rotation, the external roller is forced toward the inner roller to form or groove the wall of the pipe. At the same time, the shape of the rollers is such that the terminal end of the pipe is turned or tapered inwardly.

In the apparatus, means are provided to locate the end of the pipe relative to the rollers. The rollers are mounted on a carriage so that the inner roller and outer roller are adjustable toward and away from one another. The adjustment is accomplished by use of an eccentric mounting of the outer roller. When the rollers are adjusted to contact the pipe wall, a power means is available to move the external roller toward the internal roller and thereby deform the wall of the pipe.

BRIEF DESCRIPTION OF THE DRAWINGS

FIG. 3 is a view taken along line 3—3 of FIG. 2;

FIG. 4 is a view illustrating a portion of a pipe wall partially deformed by an inner and outer roller; and FIG. 5 is a schematic illustration of the mounting arrangement for the rollers to provide adjustment toward and away from one another.

DESCRIPTION OF THE PREFERRED EMBODIMENT

Figure 1:
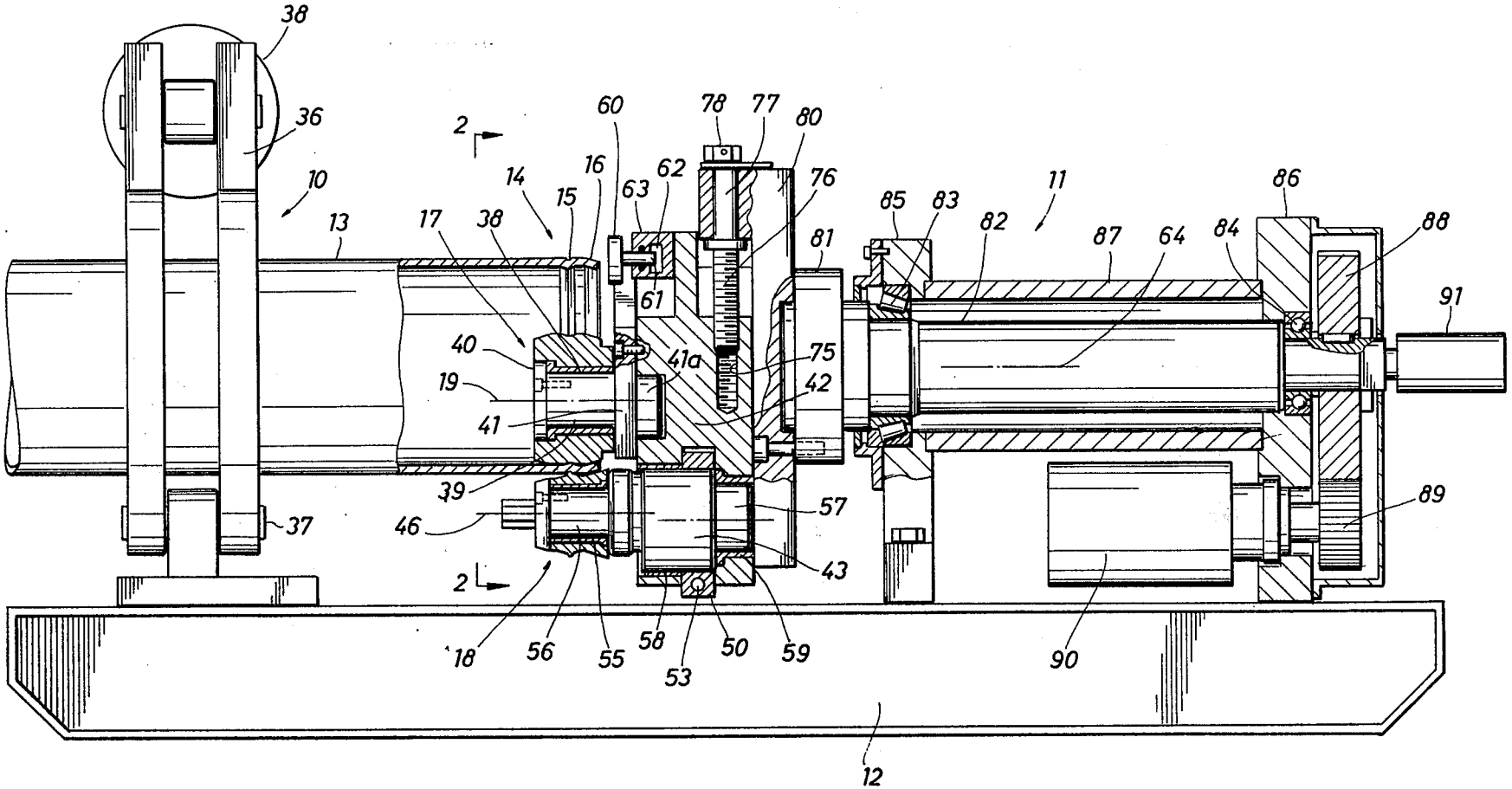
FIG. 1 is a lengthwise sectional view of an apparatus for forming the pin end of a pipe.

Referring now to FIG. 1, the apparatus generally includes a vise 10 and a deforming unit 11 which are rigidly attached to a floor skid 12. The vise 10 is constructed and arranged to grip the outside surface of a pipe 13 so as to prevent the pipe from moving longitudinally or rotationally during a deforming operation performed on an end 14 of the pipe. The deforming operation is intended to provide an annular depression or groove 15 near the terminal end of the pipe and an inwardly tapering end surface 16. While the forming of the groove 15 need not reduce the wall thickness, the equipment can be used to produce deformation of the wall.

An inner roller die member 17 and an outer roller die member 18 are rotatable respectively about a roller axis 19 and 46 and have complementarily arranged surfaces to produce the groove 15 and tapered end 16 on the pipe. The rollers 17 and 18 are illustrated more fully in FIGS. 3 and 4. As shown in FIGS. 3 and 4, the internal roller 17 has inwardly tapered end surfaces 22, 23, supporting annular surfaces 24, 25 and a central "V" shaped groove 26. The supporting surfaces 24, 25 bear upon the inside diametrical surface of a pipe 13 and the groove 26 provides an annular space to receive a wall surface of a pipe. The roller 18 (as shown in FIG. 4 from left to right on the drawing) has an outer inwardly tapered surface 27, an annular surface 28, an outwardly tapered surface 29, a projecting annular bead surface 30 with a rounded surface, an inwardly tapered surface 31, an annular surface 32 and an outwardly tapered surface 33. The rollers are juxtaposed with respect to their longitudinal axes so that the bead surface 30 of the roller 18 is centrally located of the groove 26 of the roller 17. The bead surface 30 and the tapered surfaces 29 and 31 are longitudinally dimensioned relative to the width of the groove 26 so that the wall of the pipe 13 can be indented to form the annular groove or recess 15. The sizing of the groove 26 in the roller 17 should be adequate to receive the displaced wall surface of the pipe. In operation, as will be more fully explained hereinafter, the roller 18 is moved inwardly toward the roller 17 which is fixed in position. As the roller 18 is moved inwardly, the groove 15 is formed. Inward movement of the roller 18 is continued until the annular surfaces 28 and 32 engage the outer wall of the pipe.

The angle of the tapered end surfaces 23 and 33 are similar so that the end portion 34 of the pipe is turned inwardly generally to the angle of the tapered end surfaces 23 and 33. The end surface 33 extends a greater distance relative to the length of the surface 23 to enhance the effect of turning-in of the end of the pipe.

Referring again to FIG. 1, the vise 10 can be of any conventional arrangement to accomplish the prescribed function. In the form illustrated, a pair of pipe clamps 36 (only one shown), having cylindrically shaped, diameter conforming, internal gripping surfaces (not shown) engage the outer surface of the pipe 13. The pipe clamps 36 are pivotally coupled to skid 12 as, for example, as shown at number 37 and a hydraulic/pneumatic means 38 can be used to draw the clamps 36 into gripping engagement with the pipe surface 13.

The inner roller 17, as shown in FIG. 1, is rotatably mounted on an annular bearing sleeve 38. The bearing sleeve 38 is mounted on a shaft 39 and retained thereon by a retainer cap 40. The shaft 39 extends perpendicular from a mounting plate 41 which is generally rectangular in shape and is attached to a movable carriage block 42 by bolt means. Rearwardly of the plate 41 is a pin end 41*a* which is received in a complementary shaped opening in the forward face of the block 42.

The mounting arrangement for the outer roller 18 may best be understood by reference to a schematic illustration in FIG. 5. Also, in FIG. 5, a certain degree of dimensional distortion is used to highlight the physical relationship. Roller 18 is attached eccentrically to a positioning shaft 43. The positioning shaft 43 is rotatably mounted in the carriage block 42 for rotation about its axis 44. A nut 45 on the outer end of the roller 18 is provided so that the axis 46 of the roller 18 can be rotated about the axis 44 and is always at a diametral distance "*d*" from the axis 44. It can be appreciated that rotation of the axis 46 about axis 44 can be used to bring a tangential surface 47 of the roller 18 into engagement with the surface of the pipe prior to deformation. This is the precise function performed to set the initial position of the outer roller into contact with the pipe. This rotational function is performed also relative to a turning arm 48 which has a portion 50 encircling the shaft 43. The encircling portion 50 has spaced apart ends 51, 52 which can be drawn together by a bolt means 53. The bolt means 53 loosens or tightens the encircling portion 50 on the shaft 43. The bolt 53 in the encircling portion 50 is loosened to rotate shaft 43 and position the outer roller 18 relative to the pipe surface. The bolt 53 is tightened prior to the indentation being made in the pipe. When the arm 48 is attached to the shaft 43 by the tightening of the bolt 53, then a force (illustrated by the arrow 55) on the end of the turning arm 48 rotates the axis 46 of the roller 18 relative to the axis 44 of the positioning shaft 43, and hence, forces the roller into the surface of the pipe.

Figure 2:
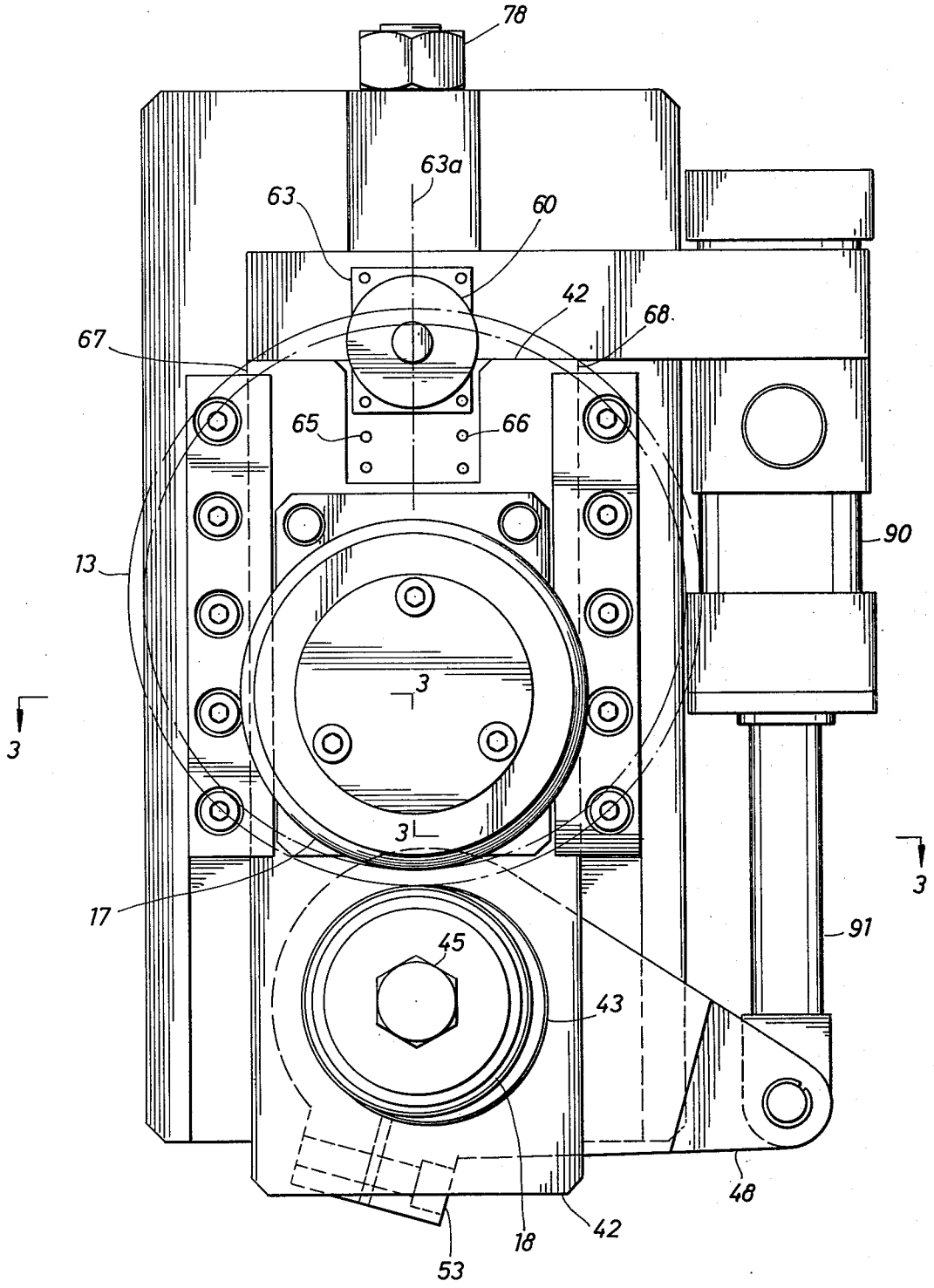
FIG. 2 is view taken along line 2—2 of FIG. 1.

The exact arrangement for the mounting of roller 18 is shown in FIGS. 1 and 2. In particular, the roller 18 is mounted on an annular bearing sleeve 55 which is mounted on a shaft 56. The shaft 56 is eccentrically attached to the positioning shaft 43. The positioning shaft 43 is mounted on a bearing sleeve 58 and has a rearward stub shaft 57 similarly mounted in a bearing sleeve 59. The bearing sleeves 58 and 59 are mounted in the carriage block 42. The encircling portion 50 is mounted about the shaft 43 in a recess in the carriage block 42.

At a location diametrically opposed from the roller 18 is a stop member 60 which is cylindrically shaped. The stop member 60 has a piston portion 61 which extends into a hydraulic cylinder 62 The cylinder 62 is connected to a hydraulic/pneumatic flow line (not shown) whereby pressure can be applied to extend the stop member 60 into engagement with the end of a pipe 13 for positioning. The pressure on the stop member can be released prior to deforming the wall to retract the stop member from the pipe end. The cylinder 62 is within a cylinder block 63 which can be vertically adjusted along a vertical axis 63*a* which intersects a horizontal rotational axis 64 (See FIG. 1) for the carriage block 42. The vertical adjustment can be accomplished in various ways and a series of spaced apart locating bolt holes 65 and 66 (See FIG. 2) is illustrated as exemplary. The bolt holes are to threadedly attach the cylinder block to the carriage block 42.

The carriage block 42 includes parallel side surfaces 67, 68 (See FIGS. 2, 3) which are slidably received in parallel guideways 69, 70 and retained therein by longitudinally extending flanges 71, 72 on the carriage block. Thus the carriage block 42 is free to travel in a transverse direction to the horizontal rotational axis 64. To control the positioning and travel of the carriage block 42 it has a threaded bore 75 which receives a threaded bolt 76. The bolt is rotationally mounted at 77 in a mounting plate 80 so that, upon turning an exterior nut 78, the carriage block 42 can be positioned relative to the rotational axis 64. The mounting plate 80 is generally rectangularly shaped and attached to a mounting flange 81 of a driving shaft 82. The driving shaft 82 is rotatably mounted by bearings 83, 84 in forward and rearward support frames 85, 86 and has a hollow interior (not shown). A tubular case 87 encloses the central portion of the shaft 82. A driving gear 88 is attached to the end of the shaft 82 and driven by a gear 89 on a hydraulic motor 90. At the end of the shaft 82 is a conventional fluid exchange device 91 which inputs and exits fluid and has a rotational seal. Thus, hydraulic or pneumatic pressure can be applied through the interior of the shaft 82 to the hydraulic or pneumatic devices on the rotating assembly. The hydraulic or pneumatic devices include the cylinder 63 and a cylinder 90 which is attached to the carriage block 42. The cylinder 90 has a piston rod 91 attached to the turning arm 48 so as to move the roller 18 toward the roller 17.

In operation, the hydraulic or pneumatic system is actuated to extend the stop member 60 to its extended position. The proper rollers 17 and 18 for the pipe size are selected and mounted on the carriage block 42. In this regard the internal roller 17 is made somewhat larger in diameter than the external roller 18. The carriage block 42 is positioned by turning the nut 78 so that the roller 17 will be within the interior of the pipe to be rolled. The exterior roller 18 is positioned so that the pipe can be positioned against the stop 60. In other words, the rollers 17 and 18 are spread apart a sufficient distance so that the end of the pipe can pass freely between the rollers. The pipe vise 10 is opened and a pipe joint is inserted to the stop member 60. Upon positioning, the vise 10 is clamped on the pipe. Next the internal roller 17 is brought into touching engagement with the internal surface of the pipe 13 by rotation of the nut 78. A turning force is applied to the nut 45 to rotate the external roller 18 into touching engagement with the exterior of the pipe and the bolt 53 is tightened to fix the turning arm 48 to the shaft 43. The stop member 60 is next retracted and the motor 90 is started. Hydraulic/-pneumatic pressure is applied to the cylinder 90 to urge the roller 18 into the wall of the pipe. As shown in FIG. 4 the bead surface 30 on the outer roller bends or deforms the pipe wall inwardly into the matching groove in the roller 17 forming an annular groove in the pipe and at the same time the end of the pipe is turned inwardly.

It will be apparent that the embodiments herein shown and described are exemplary only, and various modifications may be made in construction, materials and arrangement yet be within the scope of the invention as defined by the following claims.

I claim:

1. Apparatus for forming a groove on the end of a pipe comprising:

carriage frame means;

internal and external rollers on said carriage frame means, said rollers respectively being mounted for rotation about parallel axes, shaft means mounting said external roller and its axis of rotation for rotation about the axis of said shaft means, a turning arm for mounting said shaft means, means in said turning arm for locking or unlocking said shaft means relative to said turning arm so that the rotational position of said shaft means relative to said turning arm can be varied;

hydraulic means coupled between said carriage frame means and said turning arm for moving said rollers toward and away from one another;

means for rotating said carriage frame means about an axis parallel to the axis of said rollers so that said rollers, as a pair, may be rotated about the axis of said carriage frame means;

said rollers respectively having an annular groove and an annular bead aligned relative to one another for forming a groove in the wall of a pipe when said rollers are moved toward one another.

2. The apparatus as defined in claim 1 wherein the annular groove and annular bead on the rollers are adjacent to complementarily arranged surfaces arranged for tapering the end of a pipe inwardly as a groove is formed in a wall surface by said annular bead and annular groove.

* * * * *